US007806612B1

(12) United States Patent
Wangler

(10) Patent No.: US 7,806,612 B1
(45) Date of Patent: Oct. 5, 2010

(54) DEVICE FOR APPLYING FLUIDS TO CONVEX SURFACES

(76) Inventor: William D. Wangler, 32685 Blue Mist Way, Wildomar, CA (US) 92595

( * ) Notice: Subject to any disclaimer, the term of this patent is extended or adjusted under 35 U.S.C. 154(b) by 856 days.

(21) Appl. No.: 11/634,052

(22) Filed: Dec. 5, 2006

(51) Int. Cl.

| | |
|---|---|
| ***A46B 11/00*** | (2006.01) |
| ***A46B 15/00*** | (2006.01) |
| ***A46B 11/06*** | (2006.01) |
| ***A47L 13/12*** | (2006.01) |
| ***A47L 11/08*** | (2006.01) |
| ***B05C 1/00*** | (2006.01) |
| ***B05C 17/01*** | (2006.01) |
| ***B05C 17/015*** | (2006.01) |
| ***B05C 17/00*** | (2006.01) |
| ***B05C 17/02*** | (2006.01) |
| ***B05C 21/00*** | (2006.01) |
| ***A61H 7/00*** | (2006.01) |
| ***B43K 5/06*** | (2006.01) |
| ***B43K 29/00*** | (2006.01) |
| ***B43M 11/02*** | (2006.01) |
| ***B44D 5/00*** | (2006.01) |

(52) U.S. Cl. ..... 401/11; 401/9; 401/10; 401/16; 401/17; 401/21; 401/28; 401/44; 401/171; 401/176; 401/195; 401/208; 15/230.11

(58) Field of Classification Search ..... 401/9–12, 401/21, 28, 44, 150, 171, 176, 195, 208, 401/218–220, 292, 16; 15/230.11
See application file for complete search history.

(56) References Cited

U.S. PATENT DOCUMENTS

| | | | | |
|---|---|---|---|---|
| 2,805,439 | A | | 11/1954 | Parker |
| 2,881,461 | A | | 4/1959 | Parker |
| 2,903,731 | A | | 9/1959 | Huhtala |
| 2,994,899 | A | | 8/1961 | Moilanen |
| 3,008,167 | A | | 11/1961 | Pharris |
| 3,394,423 | A | | 7/1968 | Bischoff |
| 3,662,422 | A | | 5/1972 | Christensen |
| 3,981,595 | A | | 9/1976 | Blake |
| 4,359,049 | A | * | 11/1982 | Redl et al. ..... 604/82 |
| 5,035,022 | A | | 7/1991 | Iuliano |
| 5,713,095 | A | | 2/1998 | Wakat |
| 6,499,177 | B2 | | 12/2002 | Napolitan |
| 6,505,374 | B1 | | 1/2003 | Weihrauch |
| 6,532,617 | B2 | | 3/2003 | Russo |
| 6,601,262 | B2 | | 8/2003 | Janssen |
| 6,957,470 | B2 | | 10/2005 | Rivadeneira |
| 2004/0111818 | A1 | | 6/2004 | Ma |

(Continued)

FOREIGN PATENT DOCUMENTS

| | | |
|---|---|---|
| GB | 2172820 | 10/1986 |

*Primary Examiner*—David J. Walczak
*Assistant Examiner*—Ryan A Varnum

(57) ABSTRACT

The present invention may be used for applying fluids to a convex surface. A handle may be attached to a fluid dispensing assembly that may have a roller applicator assembly attached. The roller applicator assembly may have rollers rotatably disposed on a bracket with two of the rollers positioned at an oblique angle to an intermediate roller. The fluid dispensing assembly may have a body with a first fluid channel in fluid communication with a first fluid container in the handle and a second fluid channel in fluid communication with a second fluid container in the handle, and a piston in each fluid container. The first fluid channel may have an aperture adjacent a first roller and a second aperture adjacent the intermediate roller. The second fluid channel may have an aperture adjacent a second roller and a second aperture adjacent the intermediate roller.

15 Claims, 2 Drawing Sheets

U.S. PATENT DOCUMENTS

2005/0020948 A1* 1/2005 Gueret ..... 601/122
2005/0147761 A1* 7/2005 Parks et al. ..... 427/421.1
2005/0249541 A1* 11/2005 Habatjou ..... 401/220
2009/0020551 A1* 1/2009 Malvar et al. ..... 222/1

* cited by examiner

DEVICE FOR APPLYING FLUIDS TO CONVEX SURFACES

BACKGROUND OF THE INVENTION

This invention relates to devices for applying fluids, for example, paint, coatings and the like, to convex surfaces. The new applicator device allows application of two or more fluids having different characteristics to be applied in a manner that may allow blending of the fluids on surfaces intermediate to abutting surfaces, for example, two adjoining walls of a structure may have a different color of paint applied and a curved or angular transition surface between the two walls may have a mixed or blended color applied.

Devices for applying coatings to convex curved surfaces and to obtuse or right angle interior walls may currently be known. These paint rollers or brushes may be designed for application of one color or a trim line at a corner of a structure on a curved surface. Some devices may have separated roller structures on one handle that may allow a different paint on each roller, for example, using a partitioned paint tray; however, these devices generally are structured for decorating on a flat surface. These devices may also not have a container as part of the device to apply paint to separate rollers while being used. There also may not be an applicator for application of different paint colors on a roller of multiple rollers to allow blending of paint for surface application.

SUMMARY OF THE INVENTION

The present invention is directed to devices for applying fluids to a convex surface. A handle may be attached at a distal end to a fluid dispensing assembly and a roller applicator assembly may be attached to the fluid applicator assembly. The roller applicator assembly may have three or more rollers rotatably disposed on a bracket with at least two of the rollers positioned at an oblique angle to one of the rollers positioned intermediate the oblique rollers. The fluid dispensing assembly may have a body with a first fluid channel in fluid communication with a first fluid container in the handle and a second fluid channel in fluid communication with a second fluid container in the handle. The first fluid channel may have a first aperture positioned adjacent a first oblique angle roller and a second aperture positioned adjacent the intermediate roller. The second fluid channel may have a first aperture positioned adjacent a second oblique angle roller and a second aperture positioned adjacent the intermediate roller. A piston may be slidably inserted in each of the fluid containers.

These and other features, aspects and advantages of the present invention will become better understood with reference to the following drawings, description and claims.

DETAILED DESCRIPTION

The following detailed description represents the best currently contemplated modes for carrying out the invention.

The description is not to be taken in a limiting sense, but is made merely for the purpose of illustrating the general principles of the invention.

Figure 1:
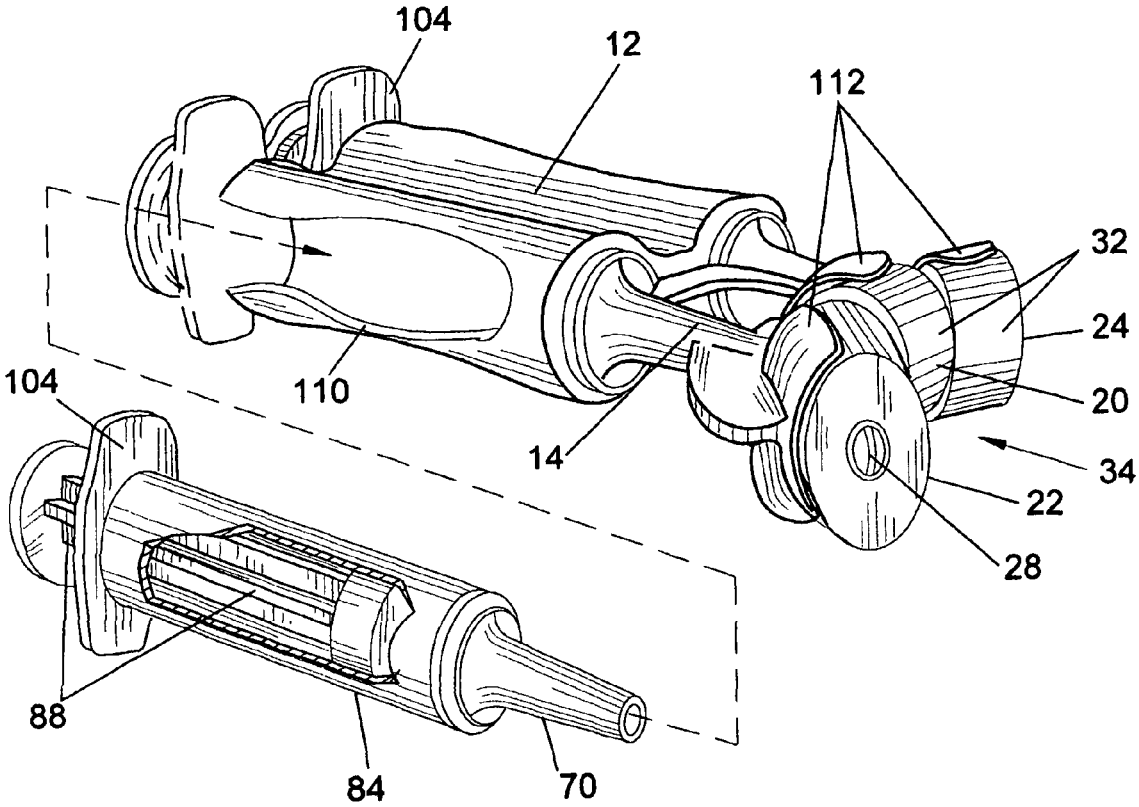
FIG. 1 illustrates a perspective view of an applicator device according to an embodiment of the invention.
Figure 2:
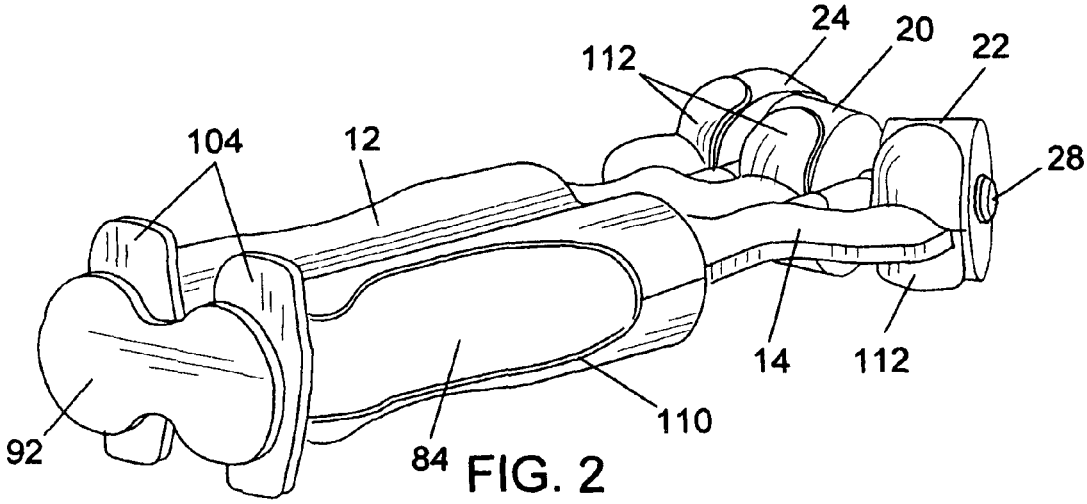
FIG. 2 illustrates a perspective view of an applicator device according to an embodiment of the invention.
Figure 3:
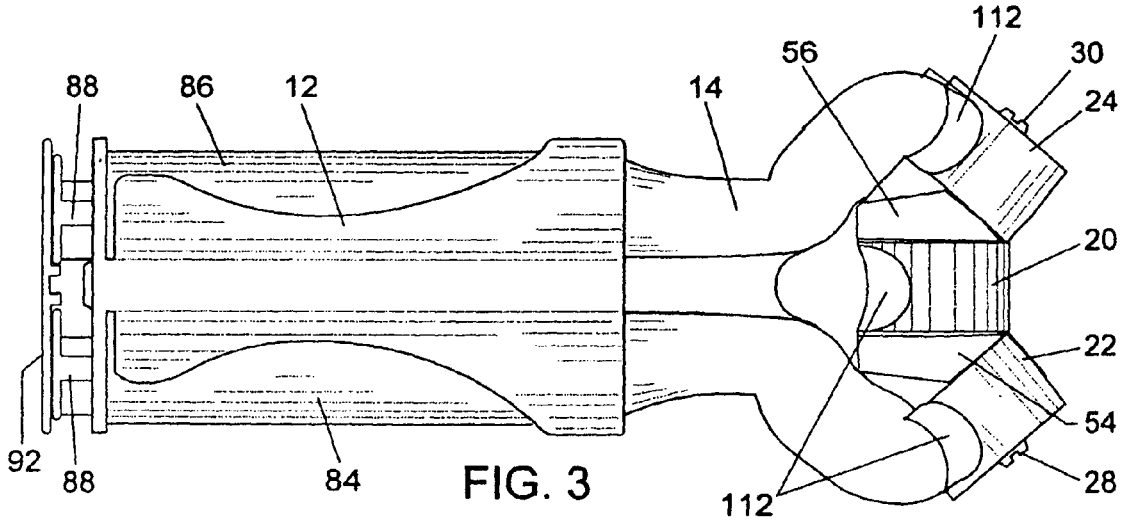
FIG. 3 illustrates a top view of an applicator device according to an embodiment of the invention.
Figure 4:
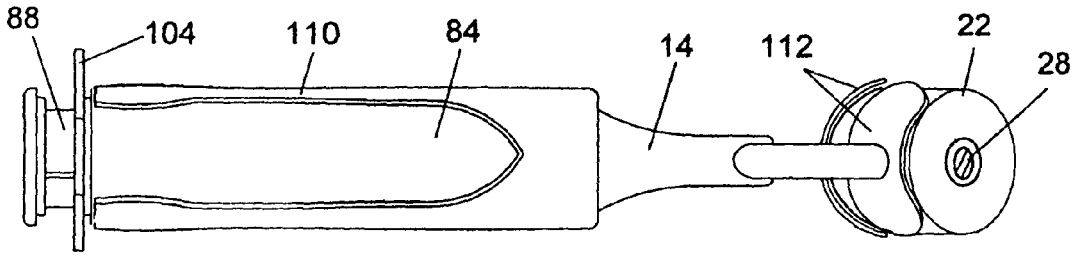
FIG. 4 illustrates a side elevation view of an applicator device according to an embodiment of the invention.
Figure 5:
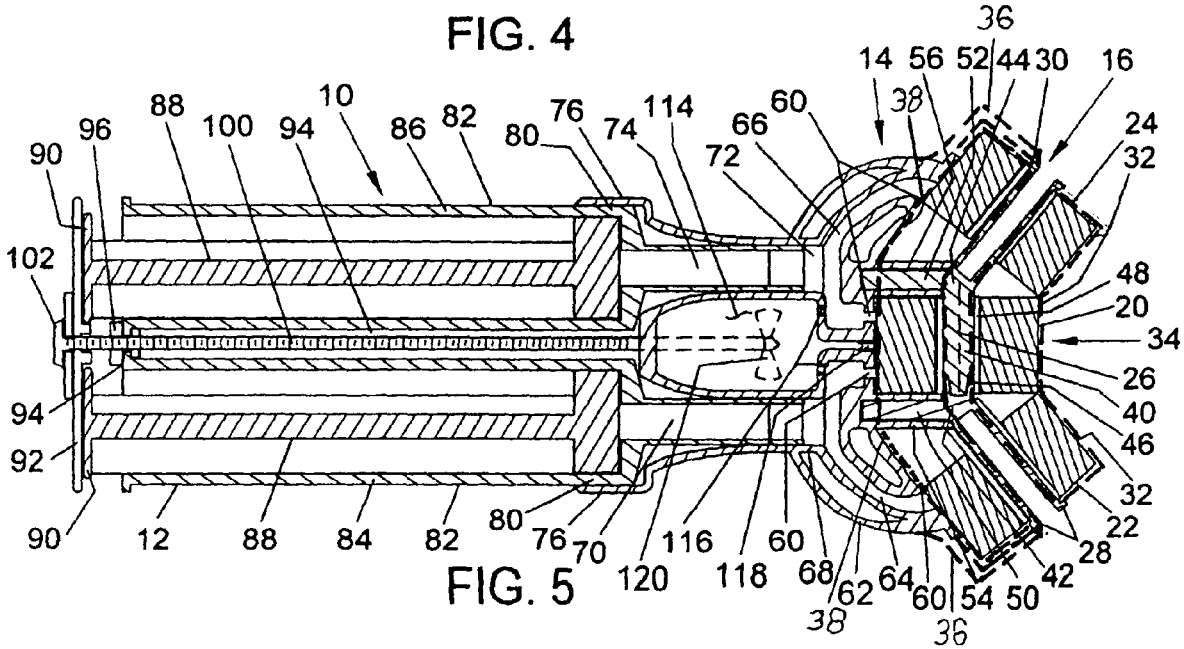
FIG. 5 illustrates a cross-sectional top view of an applicator device according to an embodiment of the invention.

Referring to FIGS. 1 through 5, an applicator device 10 may have a handle 12 attached to a fluid dispensing assembly 14 that is attached to a roller applicator assembly 16. The roller applicator assembly 16 may have a center roller 20 with a right roller 22 and left roller 24 positioned adjacent the center roller 20 with each roller centerline in a common planar orientation.

The right and left rollers 22, 24 may be positioned at an oblique angle relative to the rotational centerline 26 of the center roller 20. The attachment shafts 28, 30 of the right and left rollers 22, 24 may be attached to the fluid dispensing assembly 14 at an obtuse angle relative to the centerline 26 to position rollers 20, 22, 24 application surfaces 32 to present an approximate concave, combined application surface as viewed at the front 34 of the applicator device 10. The right and left rollers 22, 24 may be positioned such that their attachment shafts 28, 30 are approximately at right angles relative to their centerline axes. This may allow the applicator surfaces 32 to be positioned against a convex curved or angular surface object such as a corner of two abutting walls that may mate at approximately 90 degrees, to allow applying fluids from the applicator device 10 on each adjoining wall and the mating edge or surface thereof. This may be particularly useful for painting corners that have a curved or angular mating surface such as bull nose corners in buildings.

While a three roller applicator assembly 16 has been described and illustrated, additional rollers may be used to create the desired curved front fluid application surface depending on the curved structural surface to be treated. For example, two walls may not abut at a right angle, but may abut at less than or more than 90 degrees, such as 135 degrees. Also, the rollers may not be positioned in a common plane orientation, but may be offset relative to one another to allow applying a fluid to a structure with abutting surfaces mating at an acute angle, obtuse angle or 90 degrees. The rollers of the roller applicator assembly 16 may have application surfaces 32 that are a convex or concave curved form in breadth or from side to side to adapt the applicator device 10 for application of a fluid to a convex surface.

The rollers 20, 22,24 may be attached by a bracket 40 that may have a right element 42 and a left element 44 that may be connected at a right center shaft element 46 and a left center shaft element 48. There may be a right attachment post 50 and a left attachment post 52 positioned for insertion in a right attachment sleeve 54 and a left attachment sleeve 56 formed as part of the fluid dispensing assembly 14. The right attachment shaft 28 may be an element of the right element 42 and the left attachment shaft 30 may be an element of the left element 44. The bracket 40 may also be formed with a single curved shaft 38 and the rollers 20, 22, 24 may be rotatably positioned on the shaft or a single roller may be used on a single shaft with end attachment posts 36. The rollers 20, 22, 24 may also slide laterally on a shaft.

The bracket 40 may position the rollers 20, 22, 24 such that their applicator surfaces 32 may rotate against the fluid dispensing assembly 16 at apertures 60. The fluid dispensing assembly 16 may have a body 62 with a right fluid channel 64 and a left fluid channel 66. The right fluid channel 64 may be connected at a first end 68 to a right output tube 70 of the handle 12. The right output channel 64 may channel fluids to an aperture 60 adjacent the right roller 22 and an aperture 60 adjacent the center roller 20. The left fluid channel 66 may be connected at a first end 72 to a left output tube 74 of the handle 12. The left output channel 66 may channel fluids to an aperture 60 adjacent the left roller 24 and an aperture 60 adjacent the center roller 20. The fluid dispensing assembly 14 may be releasably attached to the distal end 80 of the handle 12 with a friction fit flange 76 overlapping the outer surface 82 of the distal end 80.

The handle 12 may have a right fluid container 84 and a left fluid container 86 with the containers 84, 86 formed as hollow cylinders. The output tubes 70, 74 may be attached at the distal end 12 positioned for insertion in the fluid dispensing assembly 14. A piston 88 may be inserted in each fluid container 84, 86 for slidable movement against a fluid, such as paint or other coating fluids, to force the fluids out of the fluid containers 84, 86. The pistons 88 may be attached at a proximal end 90 by a connector 92. A user may apply force, by for example using a thumb against the connector 92 to urge the pistons 88 to slide in the containers 84, 86. This may force fluid through the output tubes 70, 74 and through the fluid channels 64, 66 to exit through apertures 60 to be deposited on the rollers 20, 22, 24.

The handle 12 may also have a central elongated cavity 94 formed longitudinally in the handle 12. There may be a threaded aperture 96 at the proximal end 98 of the cavity 94 for threadable receipt of a threaded shaft 100. The threaded shaft 100 may be rotatably attached to the connector 92 and may have a knob 102. The threaded shaft 100 may be rotated to urge the connector 92 toward and away from the proximal end 98 to move the pistons 88.

As an alternative, the handle 12 and fluid dispensing assembly 14 may be formed as a single assembly with side slots 110 formed to allow insertion and removal of the fluid containers 84, 86 and output tubes 70, 74 from the handle 12. The fluid containers 84, 86 with output tubes 70, 74 and pistons 88 may resemble a syringe with a hollow barrel, output tubes and plunger as best viewed in FIG. 1. The fluid containers 84, 86 may have a rim element 104 to aid in gripping the applicator device 10.

There may be roller guards 112 positioned adjacent a portion of the rollers 20, 22, 24 to reduce dripping or splattering of paint and to aid in spreading paint on the rollers. There may be a mixing chamber 114 in the fluid dispenser assembly 14 with an impeller 120 disposed therein and attached to the threaded shaft 100. The apertures 60 adjacent the center roller 20 may be closed and mixer apertures 116 may be formed in the walls of the fluid channels 64, 66 to allow fluid to enter the mixing chamber 114. An outlet aperture 118 may be formed in the wall of the mixing on the center roller 20.

While the invention has been particularly shown and described with respect to the illustrated embodiments thereof, it will be understood by those skilled in the art that the foregoing and other changes in form and details may be made therein without departing from the spirit and scope of the invention.

I claim:

1. A device for applying fluids to a convex surface comprising:

a handle attached at a distal end to a fluid dispensing assembly and a roller applicator assembly attached to said fluid dispensing assembly;

said roller applicator assembly having at least three rollers rotatably disposed on a bracket with at least two of said rollers disposed at an oblique angle to one of said rollers intermediate said at least two rollers;

said fluid dispensing assembly having a body with a first fluid channel in fluid communication with a first fluid container disposed in said handle and a second fluid channel in fluid communication with a second fluid container disposed in said handle;

said first fluid channel having a first aperture disposed adjacent a first one of said oblique angle rollers and a second aperture disposed adjacent said intermediate roller;

said second fluid channel having a first aperture disposed adjacent a second one of said oblique angle rollers and a second aperture disposed adjacent said intermediate roller; and a piston slidably inserted in each of said first fluid container and said second fluid container.

2. The device as in claim 1 wherein each of said roller centerlines is in a common planar orientation.

3. The device as in claim 1 wherein said rollers have a paint applicator surface abutting said apertures.

4. The device as in claim 1 wherein said at least two rollers are disposed on said bracket at an obtuse angle relative to a front.

5. The device as in claim 4 wherein said oblique angle rollers are disposed on said bracket with centerlines at an approximately orthogonal orientation.

6. The device as in claim 1 wherein said bracket comprising:

a first element with a first post disposed for insertion in a first attachment sleeve of said body, with a first attachment shaft disposed for rotational attachment of a first oblique angle roller, and with a first center shaft element;

a second element with a second attachment post disposed for insertion in a second attachment sleeve of said body, with a second attachment shaft disposed for rotational attachment of a second oblique angle roller, and with a second center shaft element disposed to mate with said first center shaft element; and a center roller rotatably attached to said first center shaft element and said second center shaft element.

7. The device as in claim 1 wherein said first fluid container having a first output tube disposed for insertion in a first end of said first fluid channel and said second fluid container having a second output tube disposed for insertion in a first end of said second fluid channel.

8. The device as in claim 1 wherein said body having a flange for frictional attachment to said distal end of said handle on an outer surface.

9. The device as in claim 1 wherein a connector is attached to a proximal end of each of said pistons.

10. The device as in claim 1 wherein said first fluid container and said second fluid container are removably retained in said handle.

11. The device as in claim 1 wherein:

said handle has a central elongated cavity formed longitudinally therein and has a threaded aperture at a proximal end thereof; and a threaded shaft threadably extending through said threaded aperture and rotatably attached to a connector abutting a proximal end of each of said pistons.

12. The device as in claim 1 wherein a roller guard is disposed adjacent each of said rollers.

13. A device for applying fluids to a convex surface comprising:

a handle attached at a distal end to a fluid dispensing assembly and a roller applicator assembly attached to said fluid dispensing assembly;

said roller applicator assembly having a roller rotatably disposed on a curved shaft shaped to maintain said roller in a concave form relative to a front of said roller applicator assembly;

said fluid dispensing assembly having a body with a first fluid channel in fluid communication with a first fluid container disposed in said handle and a second fluid channel in fluid communication with a second fluid container disposed in said handle;

said first fluid channel having a first aperture disposed adjacent a first end of said roller and a second aperture disposed adjacent a center portion of said roller;

said second fluid channel having a first aperture disposed adjacent a second end of said roller and a second aperture disposed adjacent said center portion of said roller; and a piston slidably inserted in each of said first fluid container and said second fluid container.

14. A device for applying fluids to a convex surface comprising:

a handle attached at a distal end to a fluid dispensing assembly and a roller applicator assembly attached to said fluid dispensing assembly;

said roller applicator assembly having a roller rotatably disposed on a curved shaft shaped to maintain said roller in a concave form relative to a front of said roller applicator assembly;

said fluid dispensing assembly having a body with a first fluid channel in fluid communication with a first fluid container disposed in said handle and a second fluid channel in fluid communication with a second fluid container disposed in said handle;

said first fluid channel having a first aperture disposed adjacent a first end of said roller and a second aperture in fluid communication with a mixing chamber;

said second fluid channel having a first aperture disposed adjacent a second end of said roller and a second aperture in fluid communication with said mixing chamber;

said mixing chamber having an outlet aperture disposed adjacent a center portion of said roller; and a piston slidably inserted in each of said first fluid container and said second fluid container.

15. The device as in claim 14 further comprising:

said handle has a central elongated cavity formed longitudinally therein and has a threaded aperture at a proximal end thereof; and a threaded shaft threadably extending through said threaded aperture and an impeller attached at a distal end of said threaded shaft and disposed in said mixing chamber; and said threaded shaft rotatably attached to a connector abutting a proximal end of each of said pistons.

* * * * *